11/6/84 XR 4,481,249

United States Patent [19]

Ebneth et al.

[11] Patent Number: 4,481,249

[45] Date of Patent: Nov. 6, 1984

[54] METALLIZED CARBON FIBRES AND COMPOSITE MATERIALS CONTAINING THESE FIBRES

[75] Inventors: Harold Ebneth, Leverkusen; Lothar Preis, Bergisch-Gladbach; Henning Giesecke, Cologne; Gerhard D. Wolf, Dormagen, all of Fed. Rep. of Germany

[73] Assignee: Bayer Aktiengesellschaft, Leverkusen, Fed. Rep. of Germany

[21] Appl. No.: 507,873

[22] Filed: Jun. 24, 1983

Related U.S. Application Data

[62] Division of Ser. No. 344,908, Feb. 2, 1982, abandoned.

[30] Foreign Application Priority Data

Feb. 21, 1981 [DE] Fed. Rep. of Germany ..... 3106506

[51] Int. Cl.[3] ..... B32B 9/00; B32B 27/00; B05D 3/00; D04H 1/58

[52] U.S. Cl. ..... 428/288; 427/305; 427/383.1; 428/290; 428/332; 428/367; 428/389; 428/408; 428/413; 428/418; 428/902

[58] Field of Search ..... 428/367, 389, 332, 336, 428/408, 288, 290, 413, 418, 902, 605, 608; 427/383.1, 383.3, 305, 304; 204/192 C

[56] References Cited

U.S. PATENT DOCUMENTS

| | | | |
|---|---|---|---|
| 2,532,283 | 12/1950 | Brenner et al. | 427/305 |
| 3,550,247 | 12/1970 | Evans et al. | 427/305 X |
| 3,671,285 | 6/1972 | Prescott | 428/389 |
| 3,671,291 | 6/1972 | Miller | 427/305 X |
| 3,833,402 | 9/1974 | Elban et al. | 428/367 |
| 4,169,911 | 10/1979 | Yoshida et al. | 428/389 |
| 4,341,823 | 7/1982 | Sexton et al. | 427/305 X |

*Primary Examiner*—Lorraine T. Kendell

*Attorney, Agent, or Firm*—Sprung, Horn, Kramer & Woods

[57] ABSTRACT

Carbon filaments and fibres and sheets manufactured from them which have excellent properties of adherence to plastics without loss of tensile strength are obtained when the carbon filaments and fibres are provided with a metal coating by a current-less process.

7 Claims, No Drawings

METALLIZED CARBON FIBRES AND COMPOSITE MATERIALS CONTAINING THESE FIBRES

This is a division, of application Ser. No. 06/344,908, filed Feb. 2, 1982, now abandoned.

Numerous processes are known chemically modifying the reinforcement fibres used in the maufacture of composite fibre materials in order that the adherence between the fibres and matrix is improved. The adherence between the components is essential for many of the properties of the composite materials required in use.

Numerous methods are known, for example, improving the adherence of carbon fibres which have a low to medium elastic modulus (e.g. British Pat. No. 1,238,308, German Offenlegungsschrift No. 2,110,193 and German Auslegeschrift No. 2,252,128).

No satisfactory method has yet been found, however, for modifying those carbon fibres which have an elastic modulus above 300,000 MPA which would enable the reinforcing effect of such fibres to be fully utilized in the composite material (Angew. Chem. 92, 375 (1980).

One measure of the adherence between the components of a composite system is the interlaminar shear strength (ILS). If the ILS is high, the adherence between the components is strong.

It has been found in practice that the modifying substances capable of improving the bond between fibre and matrix depend very specifically both on the material of the fibres and on the material of the matrix. Thus, for example, products which increase the ILS for glass fibres are unsuitable for carbon fibres. It has now been found that carbon filaments or fibres and sheets manufactured therefrom may be obtained with excellent characteristic of adherence to plastics without any loss, in their tensile strength if they are first provided with a metal coating by a current-less process.

The carbon fibres may be derived from various starting materials, e.g. cellulose derivatives and special types of pitch, for example bitumen, or polyacrylonitrile.

The present invention thus provides carbon filaments, fibres and sheets coated with a metal layer applied by a current-less process. The preferred metals include nickle, cobalt, copper, gold, silver and alloys of these metals with each other or with iron. The thickness of the metal layer is from 0.05 to 10 μm, preferably from 0.1–1 μm. Preferred carbon fibres have a carbon content above 80% by weight. Those fibres having a graphite-like structure and an elastic modulus above 300,000 MPa are particularly preferred.

Metals which are particularly preferred are cobalt and nickel as well as cobalt-nickel, cobalt-iron, nickel-iron and cobalt-nickel-iron alloys.

The invention further provide composite materials of carbon fibres metallized by a current-less process and polymer matrices, which materials are characterised by their improved adherence between fibre and matrix.

Preferred embodiments of these composite materials contain those carbon fibres which have previously been mentioned as preferred.

The metal layer deposited on the fibres is firmly bonded to the substrate.

Comparative investigations between metallized and non-metallized carbon fibres show that the tensile strength and E-modulus of the fibres are not impaired by the metallization and that the ILS of composite materials manufactured from metallized carbon fibres is increased by up to 100% compared with that of control materials in which for comparison the fibres have not been thus treated.

Another advantage of the composite materials reinforced with metallized carbon fibres is that the metallization renders the substrates electrically conductive. Various degrees of protection against electrostatic charging, including protection against lightning, can thus be obtained on the thickness of the metal layer applied. The use of metals such as nickel or cobalt, for example, provides a sheild against electromagnetic radiation.

The improvement in the ILS is obtained with plastics based on various starting materials. The following classes of polymers, for example, are suitable for carbon fibres metalized according to the invention: expoxide resins, polyester resins, phenol resins, aminoplasts, polyurethane resin, silicone resins, polyamides, polyimides, thermoplastic polyesters, polycarbonate and polyacrylate.

The reinforcing materials may be used in the form of fibres, woven or knitted fabrics or braided fabrics. Metallization may be carried out both on the fibres and on the textile sheets manufactured therefrom.

The metallization may be carried out by the process described in German Pat. No. 2,743,768.

The activation is preferably carried out by a method which is characterised in that the surface to be metallized is wetted with an organometallic compound of elements of sub-groups 1 and 8 of the periodic system of Elements homogeneously distributed in an organic solvent, the organic solvent is then removed and the Organo-metallic compound adhering to the surface which is to be metallized is reduced. Metallization is subsequently carried out, for example by the method described in German Pat. No. 2,743,768.

EXAMPLE 1

A carbon filament yarn is activated for 10 seconds in a solution of 0.01 g of butadiene palladium chloride, dried and then nickel coated for 5 minutes in a metallization bath at PH 8.5 containing 30 g/liter of nickel chloride. $6H_20$, g/liter of citric acid and 3 g/ liter of dimethl aminoborane.

The nickel-coated yarn is used to produce a body of expoxide resin 4× 10 mm in cross section containing 40% of carbon. The resulting body was found to have a shear strength of 46.6 $N/m^2$.

A body produced for comparison from carbon yarn which had not been nickel coated had a shear strength of 33.2 $N/m^2$.

EXAMPLE 2

Carbon fibres having an E-modulus of 415 00 MPa and a tensile strength of 2350 MPa were nickel coated following the procedure according to Example 1.

These fibres were used to produce test samples of commerical epoxide resin based on bishphenol A (cold setting) containing 50 volume % of unidirectionally orientated fibres.

The ILS value according to ASTM D 2344 was 58 MPa. A test sample containing 50 volume % of untreated carbon fibres has an ILS of 29.5 MPa.

EXAMPLE 3

Test samples were produced of a commercial polyester resin (isophthalic acid type) as matrix containing carbon fibres according to Example 2. These samples again contained 50 volume % of unidirectionally orientated fibres.

The ILS determined according to ASTM D 2344 was found to be 46.4 MPa.

A test sample of the same polyester resin containing 50 volume % untreated carbon fibres had an ILS value of 24 MPa.

We claim:

1. A composite material comprising a fiber reinforced matrix, said fiber being a nickel coated carbon fiber of graphite-like structure having an elastic modulus above 300,000 MPa, said matrix being an epoxide resin matrix, said nickel coated carbon fiber being bonded to said matrix, said carbon fibers having been metallized with said nickel by a current-less process employing an organo-metallic compound of an element of sub-group 1 or 8 of the periodic system as an activating agent and a liquid metallization bath.

2. A composite material according to claim 1 wherein the thickness of said nickel coating is 0.1 to 1 μm.

3. A composite material according to claim 1 wherein the thickness of said nickel coating is 0.05 to 10 μm.

4. A composite material according to claim 1 wherein the expoxide resin matrix composition containing said carbon fiber is one prepared by contacting a carbon fiber with butadiene palladium chloride and treating the resultant material with a nickel metallization bath.

5. A composite material according to claim 4 wherein said nickel metallization bath comprises a solution of nickel chloride.

6. A composite material according to claim 1 wherein the interlaminar shear strength between said expoxide resin matrix and said nickel coated carbon fiber is 46.4 to 58 MPa, determined in accordance with ASTM D 2344.

7. A composite material according to claim 1 wherein said nickel coated carbon fibers are in the form of woven or knitted fabrics or braided fabrics.

* * * * *